US005651863A

United States Patent [19]

Van Haag et al.

[11] Patent Number: 5,651,863

[45] Date of Patent: Jul. 29, 1997

[54] APPARATUS AND METHOD FOR TREATING A SHEET OF MATERIAL

[75] Inventors: Rolf Van Haag, Kerken; Ulrich Rothfuss, Grefrath, both of Germany

[73] Assignee: Voith Sulzer Finishing GmbH, Krefeld, Germany

[21] Appl. No.: 420,860

[22] Filed: Apr. 12, 1995

[30] Foreign Application Priority Data

Apr. 13, 1994 [DE] Germany ..... 44 12 625.5

[51] Int. Cl.[6] ..... D21G 1/00; D21G 7/00; B65H 23/04

[52] U.S. Cl. ..... 162/207; 162/281; 162/361; 162/375; 162/198; 34/446; 34/114; 100/38

[58] Field of Search ..... 162/207, 206, 162/375, 299, 280, 361, 198, 225; 34/444, 445, 446, 108, 449, 114, 201, 239; 100/38, 162 R, 93 RP; 355/106, 110, 108, 26 P, 27

[56] References Cited

U.S. PATENT DOCUMENTS

| | | | |
|---|---|---|---|
| 445,898 | 2/1891 | La Monte | 162/206 |
| 3,395,458 | 8/1968 | Whittaker et al. | 34/114 |
| 3,623,237 | 11/1971 | Whittaker et al. | 34/201 |
| 3,762,067 | 10/1973 | Whittaker et al. | 162/290 X |
| 4,080,890 | 3/1978 | Dreher | 100/162 R |
| 4,184,824 | 1/1980 | Swasey et al. | 425/75 |
| 4,211,165 | 7/1980 | Schill | 100/162 R |
| 4,247,990 | 2/1981 | Ohls et al. | 34/452 |
| 4,366,752 | 1/1983 | Koski | 100/162 R |
| 4,653,395 | 3/1987 | Verkasalo | 100/38 |
| 4,915,026 | 4/1990 | Halme | 100/162 R |

FOREIGN PATENT DOCUMENTS

| | | |
|---|---|---|
| 0501035 | 9/1992 | European Pat. Off. . |
| 2147021 | 3/1972 | Germany . |
| 2615634 | 10/1976 | Germany . |
| 4117596 | 6/1992 | Germany . |

*Primary Examiner*—Donald E. Czaja
*Assistant Examiner*—Jose A. Fortuna
*Attorney, Agent, or Firm*—Darby & Darby

[57] ABSTRACT

An apparatus and method for treating a sheet material (3) with an arrangement of rollers (6, 7), including at least one heated roller (8, 9), which defines at least one roller gap through which the sheet of material is passed and acted upon with pressure and/or elevated temperature. A housing (32) surrounds the roller arrangement (6, 7) and the treatment takes place in an environmental atmosphere, the temperature and/or humidity of which can be adjusted to a specified value. A roll of the sheet material is subjected to pretreatment to provide it with desired temperature and humidity conditions before entering the housing (32).

17 Claims, 1 Drawing Sheet

APPARATUS AND METHOD FOR TREATING A SHEET OF MATERIAL

FIELD OF THE INVENTION

The invention relates to an apparatus for treating sheet material with an arrangement of rollers which has at least one roller gap through which the material is passed with at least one heated roller. The invention furthermore relates to a method for treating sheet material with an arrangement of rollers in which the sheet material is passed through a roller gap and acted upon with pressure and/or elevated temperature.

The invention is explained in the following by means of a paper sheet. However, instead of paper, many other materials can also be treated in the same manner.

BACKGROUND OF THE INVENTION

The paper, coming out of the paper machine, is in many cases, passed through a calender in which the sheet of paper is acted upon with pressure. At the same time, in many cases, heat is supplied since one of the rollers forming the gap is heated. The surface of the sheet of paper is smoothed by the combination of heat and pressure.

The required operating speeds of the machines are constantly increasing. At the same time, a higher surface quality for the paper is also required. In order to satisfy both requirements, more heat is being supplied to the rollers. For this purpose, high heat outputs are required, with 20 kW per meter of roller length often used. However, only a very small portion of the heat energy is transferred directly from the heated roller to the paper sheet. The bulk of the heat energy radiates into the environment and is lost. This causes not only a deterioration of the working conditions in the surroundings of the calender, but also results in a considerable waste of energy. Moreover, in many cases, it is not possible to transfer sufficient energy to the paper sheet.

EP 0 501 035 A1 discloses a heat-protection hood for heated rollers, particularly for high-speed rollers in paper machines. The heated roller is constructed as the top roller of an arrangement with at least two rollers. The sheet of material is passed through the gap between the heated roller and a counter-roller. A hood surrounds the heated roller over a portion of its extent. A separating screen is disposed between the hood and the roller which forms two gaps. At the ends of the gaps, air deflectors are disposed, which deflect the air entrained in an inner gap adjacent the heated roller into the outer gap. By these means, heat losses due to convection are reduced. By dividing the heat-protection hood axially, it is also possible to influence the axial temperature profile of the rollers. In this arrangement, the hood is often inverted only over the roller and it covers only one end roller. Therefore, considerable amounts of energy are still lost.

DE 41 17 596 C1 shows a calender for treating sheet material, particularly a sheet of paper, with a heated roller, which is disposed at one end of a stack of rollers. In order to avoid heat losses, the heated roller is provided with a cover, formed by a sheet pulled over the extent of the roller and held at a distance from the roller by an air cushion. In order to avoid fluctuations in paper smoothness during the operation of the calender, it should be possible to install and dismantle this cover quickly.

DE 21 47 021 A1 shows a method and an apparatus for drying a sheet of moist material. Here several heated rollers are disposed in a housing, which has inlet and outlet openings for the sheet material. However, the sheet material is not passed through roller gaps, but is exposed to the atmosphere existing in the housing. In this arrangement, the moisture in the sheet material evaporates. The heated vapor, or steam, atmosphere is collected in a heat exchanger and the heat recovered from the steam is used to heat the heated roller.

DE 26 15 634 A1 discloses a method and an apparatus for treating sheet material, particularly a paper sheet, the material of which is dried down to the hygroscopic range. In this arrangement, the sheet material is passed over suction rollers which aspirate a steam atmosphere from a space enclosed by a housing through the material. It is intended that the sheet material be dried at those places which are too moist and moistened at those places which are too dry. The space, surrounded by the housing, is supplied with steam for this purpose.

BRIEF DESCRIPTION OF THE INVENTION

It is therefore an object of the invention to limit the loss of energy in a heated calender type arrangement and method.

This objective is accomplished by providing a closed housing, with the exception of the inlet and outlet openings, surrounding the arrangement of rollers.

The arrangement of rollers is thus encased and heat is radiated only in a limited space. Dissipation of heat by convection is also drastically lowered because the air within the housing is heated relatively rapidly. Since the air spreading along the length of the heated roller is kept hotter, more energy is transferred. Thus, by encasing the roller arrangement, or a part thereof, a considerable amount of heat energy can be saved.

In accordance with the invention, the heated air from the housing interior can escape only through the openings. At the inlet opening, sheet material entering the housing transports a small amount of the surrounding air from outside into the housing interior. At the outlet opening, the exiting sheet material transports air from the interior of the housing to the outside. While some air is thus exchanged between the interior of the housing and the surrounding atmosphere, the energy losses are relatively small in comparison with the losses from a calender roller without a housing.

Moreover, the arrangement of the invention has the advantage that the paper sheet is already heated as it enters the housing. Therefore, it enters the roller gap with an elevated temperature, so that only a slight increase in temperature is necessary for the rolling treatment. In this way, the amount of heat energy supplied to the heated rollers can be reduced, which leads to a saving of energy. The heated roller can also be disposed between two other rollers and the housing still prevents a large heat loss.

Preferably, the sheet material passes through a specified distance in the interior of the housing before it reaches the heated roller gap. Therefore, even before it enters the roller gap, the sheet material is exposed to the atmosphere in the interior of the housing, which is heated by the hot roller. It therefore enters the roller gap with an elevated temperature. The distance over which the sheet passes before reaching the heated roller can be extended owing to the fact that guide rollers over which the sheet material is passed are disposed in the interior of the housing.

Preferably, the housing has at least one opening which can be closed off and through which one roller can pass. Despite the presence of the housing, the maintenance and upkeep of the roller arrangement is not impeded. Rollers can be exchanged as in the past.

Advantageously, the housing has heat insulation to further decrease radiation losses. The heat insulation, which is relatively inexpensive, also provides noise insulation so that work in the vicinity of the roller arrangement becomes more pleasant.

Preferably, the arrangement of rollers is provided as an in-line calender at a paper machine and the housing is formed by an extension of the encasement of the dryer section. The calender is preferably integrated into the dryer section at the end of the dryer section. Therefore, the additional cost for the housing is relatively small.

In a preferred embodiment, provisions are made such that the housing has a moisture supplying apparatus, preferably constructed as a steam-supplying apparatus. This accomplishes a second advantageous effect in that the space within the housing can be provided with a controlled humidity. Users of the paper, such as printers, are constantly making greater demands on the final moisture content of the paper supplied to them. If the paper is too dry, it draws moisture in the print shop and the accuracy of the consecutively applied printing inks is no longer guaranteed. On the other hand, if the paper is too moist, there is evaporation and, with that, destruction of the surface during offset printing. Optimum results can be achieved when the moisture content of the paper is in equilibrium with the ambient moisture content of the environment in the print shop. In practice, paper sheet which leaves the dryer section with a moisture content of about 8% frequently is moistened with jet humidifiers before it loses 3% to 3.5% moisture once against the calender. Under certain circumstances, however, this final moisture content is already too low for the print shop. Steam or jet humidifiers must therefore frequently be used in the print shop in order to achieve the necessary moistening of the paper sheet. On the other hand, if the pressure and temperature treatment of the sheet is carried out in a moist atmosphere, the moisture of the sheet can additionally be influenced and adjusted. The residence time of the sheet of material in the housing and, with that, in the correspondingly moist atmosphere is relatively long, so that more permanently changed moisture results can actually be achieved.

Preferably, a moisture meter, which is connected with a controller that controls the moisture-supplying equipment, is provided at the outlet of the apparatus. This permits the humidity of the paper to be adjusted to the value specified by the print shop or by a different consumer. The moisture-supplying equipment is controlled so that the sheet of material will have this value after passing through the treating apparatus.

Preferably, the roller arrangement is preceded by a roll magazine with at least one storage space for a material-sheet roll, the storage space being disposed in a chamber, the interior of which is connected by a pipe with the interior of the housing. The sheet material stored in the magazine is thus subject to the appropriate atmosphere, that is, an elevated temperature and/or an elevated humidity. This has the further advantage that the sheet material can be supplied to the roller arrangement with a more uniform temperature over its length. The material sheet is often wound at a temperature of 40° to 70° C. onto a roll core. The sheet of material frequently has this temperature as it leaves production equipment such as a paper machine. If the roll is stored for a period of time, it cools down from the outside to the inside. The roll cools not only from the circumferential surface, but also from its end faces. This causes the temperature of the sheet material to increase continuously during the unwinding process so that a non-uniform treatment result is achieved over the length of the sheet material. On the other hand, if the roll has an opportunity to eliminate this non-uniformity in its temperature distribution, a more uniform treatment result can be achieved over the length of the sheet, and also over its width, without having to take additional measures.

In this connection, it is also preferred that the storage chamber have a heater which is connected with a return pipe to the heated roller. The temperature in the storage chamber thus can be adjusted by means of the transfer of the atmosphere from the interior of the housing. It can be adjusted additionally, or even only, by a chamber heater. For operating the chamber heater, the residual heat is used which remains from the heating of the rollers. In most cases, the residual heat is sufficient to heat the chamber so that a uniform temperature profile results in the interior of the roller.

The object of the invention is accomplished since the treatment takes place in an environment whose temperature and/or humidity can be adjusted to a specified value.

Since the sheet material already has been exposed to an environment with an elevated temperature before entering the roller gap, it has also assumed an elevated temperature. Little or no additional energy is required for heating the environment. Rather, heating is accomplished by unused energy which would otherwise be lost in the space. Since the temperature of the sheet material already is elevated, only a lesser transfer of energy in the roller gap is necessary. The heat output of the roller can be correspondingly reduced. As a result, it is possible to save energy.

In a preferred embodiment, provisions are made that an outlet parameter of the sheet material exiting from the housing is measured and that the temperature and/or humidity of the housing atmosphere is changed as a function of a difference between the outlet parameter and a specified, nominal value. The outlet parameter can, for example, be the temperature and/or the moisture content of the sheet material. With this, the housing atmosphere can be controlled in a control loop in such a manner that the sheet material develops the desired value after being processed in the atmosphere.

BRIEF DESCRIPTION OF THE DRAWINGS

The invention is described in the following by means of a preferred embodiment in conjunction with the drawing in which.

DETAILED DESCRIPTION OF THE INVENTION

Figure 1:
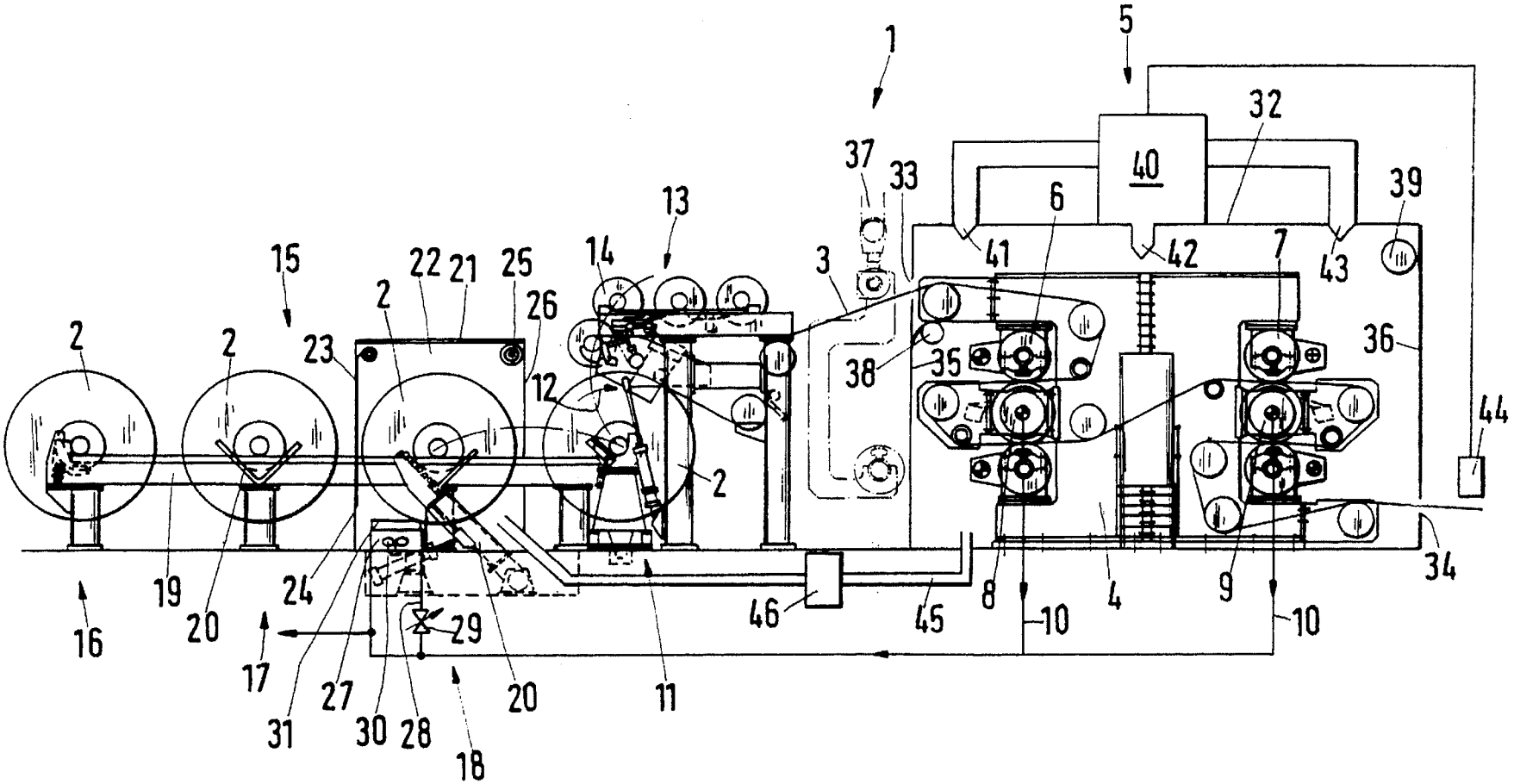
FIG. 1 shows a diagrammatic view of an apparatus in accordance with the invention for processing rolls of material in sheet form.

An apparatus 1 for processing a sheet 3 of material wound onto a roller 2 has a treatment station 5 including a calender 4. The calender 4 is illustratively shown as having two stacks 6, 7 of rollers, each with three rollers. The central roller 8, 9 of each stack 6, 7 is constructed as a heated roller. Each stack 6, 7 of rollers thus forms two heated roller gaps. A pipe, the details of which are not shown, supplies a liquid heating agent to each heated roller 8, 9. The heating agent is discharged into a return pipe 10. The sheet material 3 is passed through the calender 4 so that each side of the sheet comes into contact with a heated roller 8, 9.

An unwinding station 11, in which the supplied rolled sheet material is unwound in the direction of an arrow 12 from the roll 2, precedes treatment station 5. The unwinding station 11 has known handling equipment 13 for roll cores 14 which form the interior of each roll 2. A roll magazine 15, with several storage spaces 16, 17, 18 precedes the unwinding station 11. The storage spaces are disposed on inclined rails 19 on which the stub shafts of the rolls rest. The rolls 2 can roll on the rails 19 under the action of gravity in the direction of the unwinding station 11. The slope of rails 19 is relatively slight so that the rolls move essentially in a horizontal direction. Equipment 20 is provided, which is shown only diagrammatically, for braking the rolls 2 in the respective storage spaces and for moving the rolls out of the respective storage spaces. This is true at least for the last and next to last storage spaces 18, 17 in the roll magazine 15.

The last storage space 18 in the roll magazine 15, that is, the storage space adjacent to the unwinding station 11, is surrounded by a housing 21. The housing 21 encloses a chamber 22 that has a charging opening 24, which can be closed by a roll-up door 23, and an unloading opening 26, which can also be closed off by a roll-up door 25. Instead of the roll-up doors 23, 25, other means can also be used for closing the openings 24, 26. Examples of such means are curtain arrangements, which do not require their own driving mechanism, as do the roll-up doors 23, 25, but can be pushed aside by the roll 2 itself.

The atmosphere in the chamber 22 can be adjusted with respect to temperature and humidity to specified values. Optionally, adjusting the humidity can be omitted.

A heater 27 is provided for adjusting the temperature. The heater 27 uses the heating agent returned by the return pipe 10 from the heated rollers 8, 9 and is formed as a bypass pipeline that extends through the chamber 22. A valve 29 is provided for adjusting the amount of heating agent from return pipe 10 passing through the chamber 22. By means of control equipment, the valve 29 can be controlled in a manner not shown as a function of the temperature existing in the chamber 22.

The heating equipment 27 also has a fan 30 which forcibly blows air over the bypass pipeline to provide a uniform distribution of the heated air in the chamber 22 to essentially uniformly expose all sides of a roll to the heated air. Moreover, an air humidifier 31 is provided through which the air coming from the fan 30 passes. The relative humidity in the chamber 22 can be adjusted by means of the air humidifier 31.

The treatment station 5 is also provided with a housing 32, which is shown diagrammatically. This housing 32 has an inlet opening 33 and an outlet 34 for the sheet material 3. Openings 33 and 34 must remain open permanently. Openings 35, 36 also are provided, which can be closed and are sufficiently large so that the rollers of the stacks 6, 7 can be exchanged with the help of a diagrammatically-shown crane 37, or of some other device. The openings 35, 36 are closed off by roll-up doors 38, 39. However, sliding, flap or other types of doors can also be used. The accessibility is not as critical here, because the rollers of the stack 6, 7 have to be exchanged less frequently than the rolls 2 in the unwinding station 11.

Diagrammatically-shown guide rollers are disposed so that the sheet material 3, before passing through the first roller gap in roller stacks 6, 7, is passed over a specified distance within the interior of the housing 32, so that it is exposed to the housing's existing atmosphere. The sheet material is thus already heated before it enters the roller gap of roller stack 6.

The housing 32 is heat insulated. The insulation primarily limits the radiation of heat emitted by the heated rollers 8, 9. These rollers work throughout with heat outputs of the order of 20 kW per meter of roller length. The energy expended and the energy losses associated therewith accordingly are appreciable. By encasing the heated rollers in the housing 32, the losses are lowered.

If the treatment station 5 is not operated on-line as shown, but in-line, the housing 32 can also be formed by an extension of the casing of the preceding dryer section of the paper machine.

The housing 32 also is provided with a steam generator 40, shown diagrammatically, which blows steam into the interior of the housing 32 through three feed nozzles 41, 42, 43. The housing 32 thus also serves as a steam humidifier. The sheet material 3 passing through the housing 32 is thus exposed not only to the pressure and temperature in the roller gaps of the roller stacks 6, 7, but also to the correspondingly higher temperature and humidity of the atmosphere within the housing 32. The moisture content of the sheet material can be measured by measuring equipment 44, which is connected with and controls the steam generator 40. This results in a closed control loop for controlling the moisture content of the sheet material.

The interior of the housing 32 is connected through a pipeline 45 with the interior of the chamber 22 in which conveying apparatus 46 may optionally be provided . Transport of atmosphere from the treatment station 5 into the chamber 22 is provided through pipeline 45. In this manner, the energy emitted by the heated rollers 8, 9 can also be utilized for heating the chamber 22. If the steam generator 40 appropriately humidifies the atmosphere in the housing 32, this humidity can also be transferred into chamber 22.

The apparatus 1 works in the following manner.

A roll 2 of sheet material is deposited, for example, with the help of a crane or a lifting vehicle, on the first storage space 16 of the roll magazine 15. Whenever a roll 2 has been unwound in the unwinding station 11, this taking a time ranging from 1 to 2 hours, a roll 2 in the roll magazine 15 moves one storage space further to the right and finally reaches chamber 22. The roll is acted upon here by means of an elevated temperature and/or elevated humidity, so that the temperature distribution, which may have become nonuniform during storage in the roll magazine 15, becomes uniform once again. Thus, during the unwinding in the unwinding station 11, a roll of material conditioned to a relatively uniform temperature over its length and width, is unwound and supplied to the treatment station. In the treatment station 5, the sheet material 3 is exposed not only to high pressure and an elevated temperature in the roller gap of the stack of rollers 6, 7, 13 but also to elevated humidity which has been produced by the steam generator 40. The humidity is controlled by the measuring instrument 44, for example, to a value corresponding to the ambient humidity in a printing shop, in which the sheet of paper is to be processed.

During its stay in the chamber 22, the roll which is stored there can be rotated by a driving mechanism, the details of which are not shown. This has the advantage that the roll is heated uniformly even when the temperature distribution in the interior of the chamber 22 is not entirely uniform.

We claim:

1. Apparatus for treating a continuous sheet of paper material, comprising:

a substantially closed housing having inlet and outlet openings through which the sheet material passes;

a calender within the housing;

at least one guide roller within said housing;

wherein said calender includes a set of rollers which include a heated roller defining with at least one other opposing roller of said set at least one pressure nip through which the sheet material is passed while in said housing subject to heat and pressure from the rollers forming said at least one pressure nip, said at least one guide roller guiding said paper into or from said at least one pressure nip.

2. The apparatus of claim 1, further comprising means within said housing on which the sheet material runs for a specified distance before it reaches said at least one pressure nip.

3. The apparatus of claim 1, wherein the housing further comprises at least one opening larger than said roller through which said roller can be passed, and a closure for said opening.

4. The apparatus of claim 1 wherein said housing is heat insulated.

5. Apparatus as in claim 1 wherein there are two of said sets of rollers in said housing, the sheet material while in the housing passing through in sequence the pressure nips of each said set of rollers.

6. The apparatus as in claim 1, wherein said calender is an in-line calender that is connected to a paper machine, said housing being an extension of a housing of said paper machine.

7. The apparatus of claim 1 further comprising means for supplying humidity to the interior of said housing.

8. The apparatus of claim 7 wherein said means for supplying humidity is a steam generator.

9. The apparatus of claim 7 further comprising moisture metering means for measuring the humidity of the sheet material at the outlet opening of said housing and controlling the housing humidity supply means in response thereto.

10. Apparatus for treating sheet material comprising:

a housing having inlet and outlet openings through which the sheet material passes;

a set of rollers within the housing, said set of rollers including a heated roller defining with at least one other opposing roller of said set at least one pressure nip through which the sheet material is passed while in said housing subject to heat and pressure from the rollers forming said at least one pressure nip;

an enclosure forming a chamber;

a roll magazine with at least one storage space for a sheet material roll disposed in said chamber which sheet material is to be supplied to the set of rollers in said housing, and means for controlling temperature and humidity conditions in the interior of said chamber to substantially the same values as in said housing.

11. The apparatus of claim 10 further comprising a pipe providing fluid communication between the interior of said housing and said chamber.

12. The apparatus of claim 11 wherein the chamber has a heater supplied with heating fluid through a return pipe connected to said heated roller in said housing.

13. A method for treating a continuous sheet of paper material, comprising:

providing a substantially closed housing;

providing within said housing a calender having at least one guide roller and a set of rollers including at least one heated roller forming a pressure nip;

treating the sheet of paper material by passing the sheet of paper material through the pressure nip so that the sheet of paper material is acted upon with pressure and an elevated temperature;

guiding the sheet of paper with the at least one guide roller into or from the pressure nip; and controlling the temperature and humidity of the environmental atmosphere within said housing.

14. The method of claim 13 wherein said step of controlling sets the environmental atmosphere to a specified value.

15. The method of claim 13, further comprising measuring a starting parameter of the sheet material and changing the humidity of the environmental atmosphere within said housing depending on a difference between the measured starting parameter and a predetermined nominal value.

16. The method of claim 15 further comprising the steps of supplying the sheet material on a roll and pretreating the roll of material to a desired temperature and humidity before being acted on by said set of rollers in said housing.

17. The method of claim 16 wherein said starting parameter is measured after the sheet material passes through the pressure nip.

* * * * *